US006585612B1

(12) United States Patent
Weissmann

(10) Patent No.: US 6,585,612 B1
(45) Date of Patent: Jul. 1, 2003

(54) THROW DART

(76) Inventor: Jochen Weissmann, Penzstrasse 6, D-90419 Nuremberg (DE)

( * ) Notice: Subject to any disclaimer, the term of this patent is extended or adjusted under 35 U.S.C. 154(b) by 0 days.

(21) Appl. No.: 09/151,519

(22) Filed: Sep. 11, 1998

(51) Int. Cl.[7] ..... A63B 65/02
(52) U.S. Cl. ..... 473/578
(58) Field of Search ..... 473/578, 582, 473/585, 586

(56) References Cited

U.S. PATENT DOCUMENTS

| | | | | | |
|---|---|---|---|---|---|
| 3,401,938 | A | * | 9/1968 | Bear | 473/582 |
| 4,457,514 | A | * | 7/1984 | Paxman | 473/585 |
| 4,772,029 | A | * | 9/1988 | Watkins | 473/578 |
| 4,775,158 | A | * | 10/1988 | Bottelsen | 473/585 |
| 4,846,481 | A | * | 7/1989 | Wageman | 473/578 |
| 5,375,850 | A | | 12/1994 | Pickett | |
| 5,498,004 | A | * | 3/1996 | Mariella et al. | 473/578 |
| 5,967,915 | A | * | 10/1999 | Lu et al. | 473/578 |

FOREIGN PATENT DOCUMENTS

| | | |
|---|---|---|
| DE | 36 34 362 A1 | 4/1987 |
| DE | 90 15 754.0 U1 | 3/1991 |
| DE | 41 18 670 A1 | 1/1992 |
| DE | 43 01 792 C1 | 11/1993 |
| DE | 296 08 368 U1 | 10/1997 |
| GB | 510193 | 7/1939 |
| GB | 717353 | 10/1954 |
| GB | 1 341 178 | 12/1973 |
| GB | 1 486 921 | 9/1977 |
| GB | 2 009 605 A | 6/1979 |
| GB | 2 049 448 A | 12/1980 |
| GB | 2 085 740 A | 5/1982 |
| GB | 2 090 753 A | 7/1982 |
| GB | 2 097 685 A | 11/1982 |
| GB | 2 102 296 A | 2/1983 |

* cited by examiner

*Primary Examiner*—John A. Ricci
(74) *Attorney, Agent, or Firm*—Venable LLP; Robert Kinberg; Stuart I. Smith

(57) ABSTRACT

A throw dart for a dart game is provided. The throw dart has a dart tip, a central dart body, a shaft, a stabilizer attached to the shaft, and a first threaded pin having outside threads on a first end and a non-threaded extension on a second end opposite the first end. The dart body has on at least one end a hollow space for receiving the non-threaded extension of the first threaded pin. The non-threaded extension has a diameter that is adapted to an inside diameter of the hollow space to form a press fit. The dart tip is attached to one end of the dart body, the shaft is attached to another end of the dart body, and at least one of the dart tip and the shaft have inside threads that mate with the outside threads of the first threaded pin.

6 Claims, 3 Drawing Sheets

THROW DART

This application claims priority to German Patent Application No. 197 40 367.0, filed Sept. 13, 1997.

BACKGROUND OF THE INVENTION

The invention relates to a throw dart for a dart game. More particularly, the invention relates to a throw dart having a dart tip, a central dart body, and a shaft carrying a supply of feathers.

For the game of throw darts (darts), throw darts having a length of approximately 15 cm and a weight of 10 g to 25 g are thrown from a distance of, as a rule, 2.37 m onto a round board. This board with a diameter of, for example, 46 cm is divided into 20 wedge-shaped segments by a wire grid inserted into it. The segments are in turn divided into two concentric double rings. Dart hits in these segments, the double rings or the center (bull) result in a specific number of points. As described in the Brockhaus Encyclopedia, Edition 19, Volume 5, pages 146 and 147 under the keyword "darts," such a throw dart comprises a dart tip made of steel and a brass shaft, as well as plastic or natural feathers.

The throw dart is normally composed of several parts. For a so-called steel dart, e.g. as known from the GB 2 102 296 A, the dart tip made of steel is inserted into a dart body such that it can be replaced. With a so-called soft dart, e.g. as is known from the EP 0 367 558 A2, the dart tip made of plastic is screwed into the dart body. Such a plastic dart tip has a plastic thread on its end, and the dart body (barrel) has a corresponding inside thread. The same holds true for the shaft side, where aluminum or plastic shafts in particular are known for this. These shafts also have an outside thread on the end, meaning on the shaft end facing away from the feathers, which is screwed into an inside thread of the dart body.

Inherent in the design for such a throw dart or dart is the conflict that the dart must be as slender as possible to allow positioning the highest possible number of darts side-by-side in a specified hit area on the dartboard or the dart target. This is important because differently point ratings are associated with the different fields on the dartboard. On the other hand, it is necessary to provide the dart with a specific dead weight to ensure a precise trajectory. The tendency is to increase the dead weight of the dart.

To solve this conflict, namely to have a high mass on the one hand and high slenderness for the dart on the other hand, materials with high density, in the extreme case a tungsten/brass alloy, are used for the darts.

GB 2 102 296 A discloses providing various additional weights for a steel dart in order to change the total weight of the dart as needed. For this, adapters having different mass and provided with a thread can be joined with the shaft, which is then screwed into the dart body (barrel) having an inside thread on the shaft side. However, if a dart drops down, the dart body can still chip off in the region of the inside thread since the wall thickness there is comparably thin.

SUMMARY OF THE INVENTION

It is an object of the invention to provide an improved dart for a dart game which has the highest possible mass, meaning the highest possible dead weight, with simultaneously high slenderness.

This and other objects are solved by providing a throw dart for a dart game. The throw dart has a dart tip, a central dart body, a shaft, a stabilizer attached to the shaft, and a first threaded pin having outside threads on a first end and a non-threaded extension on a second end opposite the first end. The dart body has on at least one end a hollow space for receiving the non-threaded extension of the first threaded pin. The non-threaded extension has a diameter that is adapted to an inside diameter of the hollow space to form a press fit. The dart tip is attached to one end of the dart body, the shaft is attached to another end of the dart body, and at least one of the dart tip and the shaft have inside threads that mate with the outside threads of the first threaded pin.

The dart body carries on at least one end outside threads in the form of a threaded pin. The threaded pin has a non-threaded extension on its end facing the dart body. The non-threaded extension is inserted into a corresponding hollow space in the dart body. The diameter of this extension is adapted to the inside diameter of the hollow space so that a press fit can be effected. It is possible to screw the dart tip with matching inside threads, or the stabilizer shaft with matching inside threads, onto the outside threads.

The idea behind the invention is not to effect a weight increase of the throw dart as a result of the increase in the dart body length, since the dart length is limited by the rules, but to avoid a weight loss. This can be achieved by omitting the hollow space in the dart body, which is normally provided with inside threads. If the dart body is provided with the outside threads for the screw-connection, this will additionally result in a weight increase.

The outside thread will result in additional mass for the dart body, or barrel, which increases its weight accordingly. On the one hand, the mass of a barrel can be increased by 15% to 25% for the same diameter. For example, the weight increase for a dart weighing 16 g and having the same basic length of the dart body is approximately 2.6 g. On the other hand, the diameter of the barrel with a given mass can be reduced considerably and the barrel can thus become much thinner or more slender than in previous designs. For example, the diameter of a barrel weighing 18 g can be reduced without weight loss from 6 mm to 4.6 mm. It is preferable if the mass is increased and the weight adjusted with the aid of M3 outside threads at both ends of the barrel.

Providing the outside threads in the form of a threaded pin, pushed into a corresponding hollow space in the dart body, has the advantage that a broken threaded pin can be replaced rather than making the dart body useless, particularly when compared to outside threads that are formed as one piece with the dart body or is cut from the solid material. Thus, if a dart tip is broken off or a shaft is broken off, the remaining portion of the threaded pin can be removed in seconds without tools from the barrel and can be replaced with a new threaded pin.

In order to simplify the assembly of the dart, the outside threads and the threaded pin are provided on the free end with an extension serving as an insertion aid. This extension can have a cone-shaped design, wherein the free end of the threaded pin can also be without threads. However, it is advantageous if the outside threads are designed such that they guides the shaft or tip to be screwed onto the threads. For this, the number of effective thread turns is reduced to reduce the time needed to screw the shaft or tip onto the threaded pin.

With a steel dart, it is preferable if only one threaded pin is pressed into the dart body, whereas the dart tip is inserted in the traditional way into the dart body. With a soft dart, a threaded pin is pressed in at each end of the dart body. With respect to the shaft, the invention has considerable advantages for all dart models and with respect to the dart tip of the soft darts, the invention in particular has the advantage that an outside thread no longer exists, meaning there are no notching effects. The outside threads at the dart tip are frequently damaged and have a tendency to break owing to the forces acting upon the dart tip when it is dropped from the dart board and as a result of hitting the ground. The associated disadvantage of having to unscrew a broken thread from the barrel, which is time consuming and must be performed with the aid of a tool, is avoided with the throw dart according to the invention.

BRIEF DESCRIPTION OF THE DRAWINGS

The invention is explained below in further detail with the aid of exemplary embodiments shown in the drawings, wherein.

DETAILED DESCRIPTION OF THE INVENTION

Figure 1:
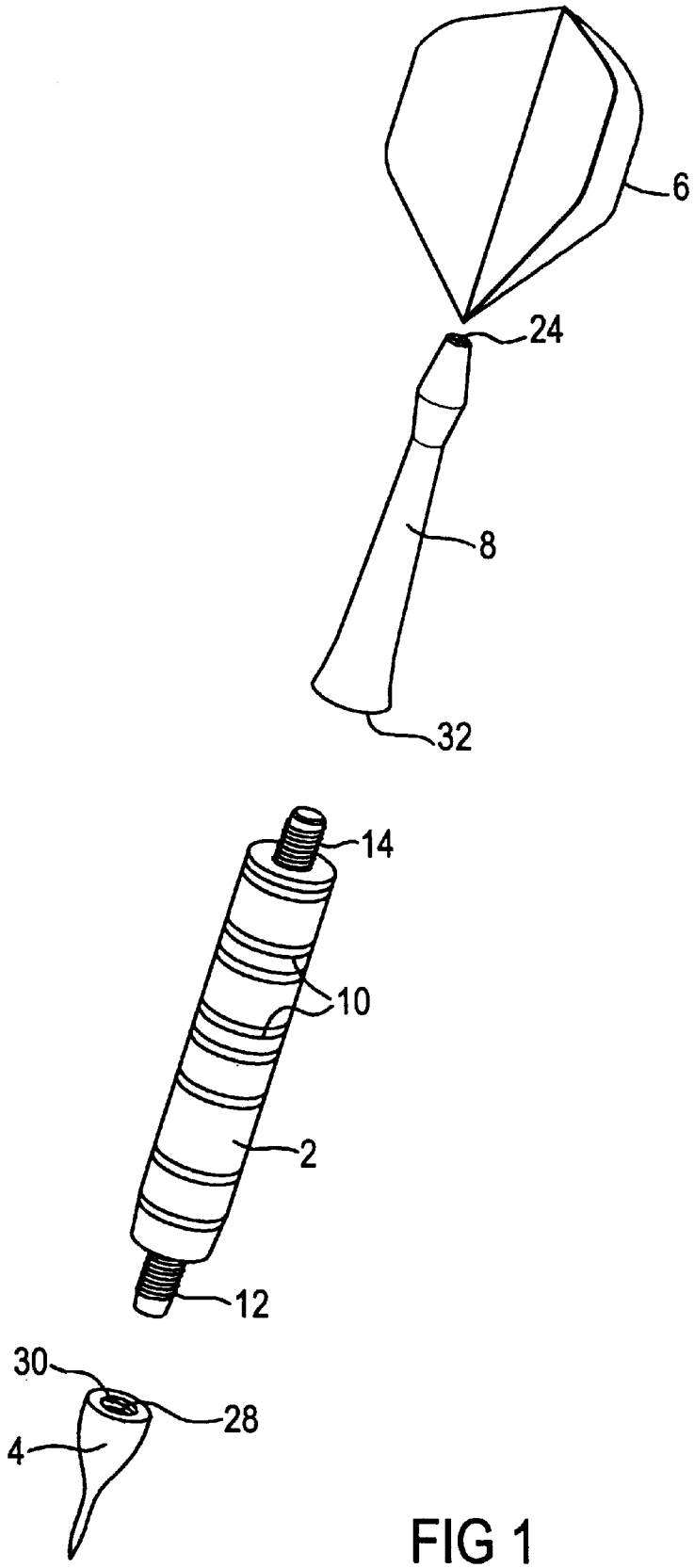
FIG. 1 is an enlarged view of a throw dart with two outside threads on the dart body.

Referring now in detail to the figures of the drawing, in which mutually corresponding parts are provided with the same reference numerals. FIG. 1 shows an example of a throw dart. The throw dart or dart has a central dart body (barrel) 2, a dart tip 4, and a shaft 8 carrying feathers or a stabilizer (flight) 6. The elongated and cylinder-shaped dart body 2 has a surface structure 10 on the casing to improve the handling since the throw dart is put into a rotational movement once it is thrown in order to stabilize its flight trajectory. Dart body 2, in particular that of a soft dart, has outside threads 12 on its end facing dart tip 4 and outside threads 14 on its end facing shaft 8. With a steel dart, outside threads 12 can be omitted if the dart tip is inserted into dart body 2 such that it can be replaced in a known manner.

Figure 2:
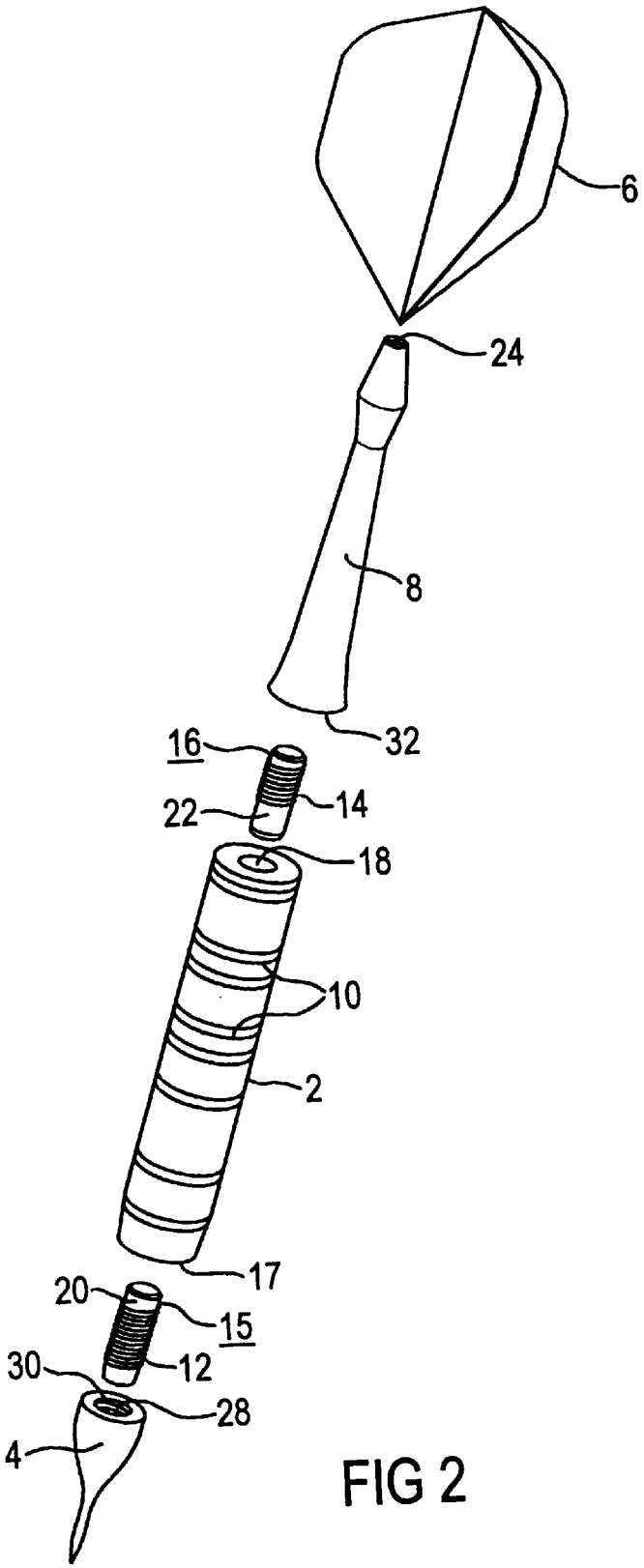
FIG. 2 is an enlarged view of a throw dart with two threaded pins prior to insertion into the dart body.

FIG. 2 shows a throw dart with outside threads 12, 14 on threaded pins 15, 16, respectively. In order to accommodate threaded pin 15, dart body 2 has on its end facing dart tip 4 a corresponding hollow space 17, into which a non-threaded extension 20 of threaded pin 15 is inserted. In an similar manner, threaded pin 16 has an extension 22 which fits into a corresponding hollow space 18 in dart body 2. The outside diameters of extensions 20 and 22 are adapted to the inside diameters of the hollow spaces 17 and 18, respectively.

When assembling the throw dart for the exemplary embodiment according to FIG. 2, threaded pins 15 and 16 are initially inserted form-fittingly into hollow spaces 17 and 18, respectively, of dart body 2 utilizing a press fit. Subsequently, dart tip 4 and shaft 8 are screwed onto the outside threads 12 and 14, respectively. For this, dart tip 4 has a hollow space 28 with an inside thread 30. In the end 32 of shaft 8 that faces dart body 2, shaft 8 has a hollow space (not visible in FIG. 2) with an inside thread corresponding to outside thread 14. Stabilizer 6 is inserted into one or several slots 24 on shaft 8, at the shaft end facing away from outside threads 14. The threaded connection secures dart tip 4 and/or shaft 8 in a form-fitting manner.

Figure 3:
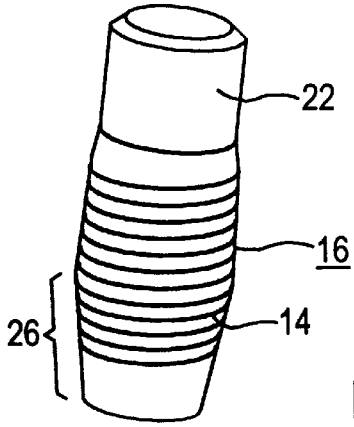
FIG. 3 is a perspective view of the threaded pin according to FIG. 2, in an enlarged illustration.

The example of threaded pin 16 in FIG. 3 is a preferred embodiment of the threaded pins. Its end facing shaft 8 (or, similarly, dart tip 4) is designed as an insertion aid. The insertion aid is provided by threaded pin 16 having an extension 26, where the outside threads 14 start with a slight taper, which increases in diameter. This preferably cone-shaped extension 26 can be either totally or partially free of threads.

Figure 4:
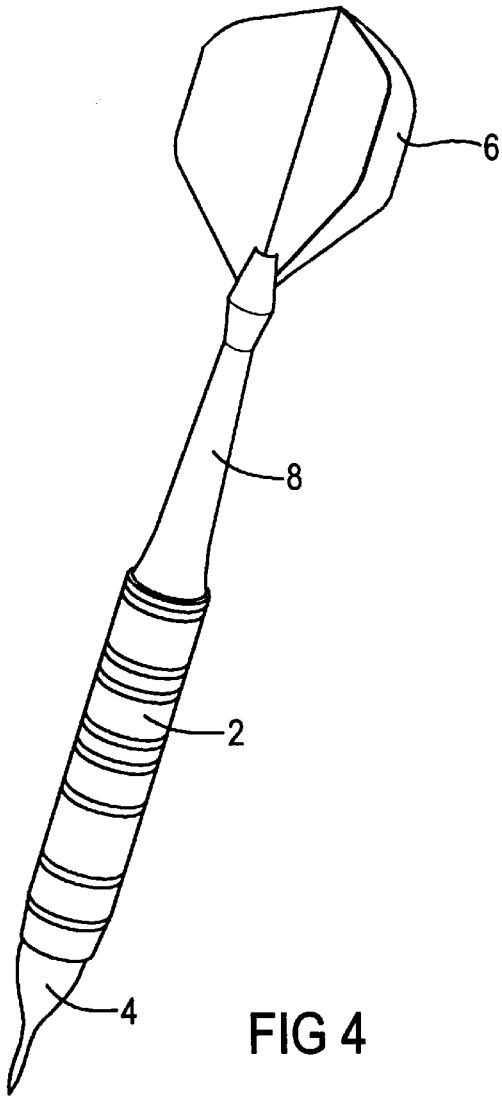
FIG. 4 shows a throw dart in accordance with the invention in the fully assembled state.

FIG. 4 shows the throw dart in the assembled state. In the case of a soft dart, dart tip 4 and stabilizer 6 are made of plastic, whereas shaft 8, for example, consists of aluminum. Dart body 2 is made of, for example, brass, a nickel/silver alloy or a tungsten/nickel alloy. As compared to traditional soft darts made of the same material, a weight increase of 15 to 25% is possible with such soft darts as a result of the additional outside thread 12, 14 in the form of threaded pins 15, 16.

Thus, the mass of a throw dart having a dart body 2 made of brass is increased from the standard 10.8 g to 13.2 g. If a tungsten/nickel alloy containing 80% tungsten is used for dart body 2, the throw dart mass is increased from 19.05 g to 23.30 g, whereas the use of 90% to 95% tungsten will result in an increase of the mass from 21.5 g to 24.7 g or from 22.8 g to 28.0 g. With a steel dart having a dart tip 4 that is pressed into dart body 2 in the traditional way, the weight increase is approximately half as much because outside threads 12 and thread shaft 20 are omitted.

Compared to a traditional barrel, the use of threaded pins 15, 16 permits a considerably more slender design for the barrel for a given total mass. For example, with an M3 outside thread 12 and 14 (meaning a metric outside thread 12, 14 with a diameter of 3 mm), a barrel 2 weighing 18 g advantageously has a diameter of only 4.6 mm.

The invention has been described in detail with respect to preferred embodiments and it will now be apparent from the foregoing to those skilled in the art that changes and modifications may be made without departing from the invention in its broader aspects. The invention, therefore, is intended to cover all such changes and modifications that fall within the true spirit of the invention.

What is claimed is:

1. A throw dart for a dart game, the throw dart comprising:

a dart tip;

a central dart body;

a shaft;

a stabilizer attached to the shaft; and a first threaded pin having outside threads on a first end and a non-threaded extension on a second end opposite the first end, wherein the dart body has on at least one end a hollow space for receiving the non-threaded extension of the first threaded pin, the non-threaded extension has a diameter that is adapted to an inside diameter of the hollow space to form a press fit, the dart tip is attached to one end of the dart body, the shaft is attached to another end of the dart body, and at least one of the dart tip and the shaft have inside threads that mate with the outside threads of the first threaded pin.

2. A throw dart according to claim 1, wherein the first threaded pin has an insertion extension at its first end, the first end facing one of the dart tip and the shaft, the insertion extension being for facilitating the insertion of the first threaded pin into the one of the dart tip and the shaft.

3. A throw dart according to claim 2, where the insertion extension is provided on its first end with threads having a reduced outside diameter as compared to the outside threads of the first threaded pin.

4. A throw dart according to claim 1, further comprising a second threaded pin, wherein the first threaded pin is attached to one end of the dart body and the second threaded pin is attached to an opposite end of the dart body, for screwing it on, the dart tip is provided with a hollows space with inside threads that corresponds to the outside threads of the first threaded pin, and for screwing it on, the shaft has a hollow space with inside threads corresponding to the outside threads of the second threaded pin.

5. A throw dart according to claim 1, wherein at least one of the dart tip, the shaft and the stabilizer is made of plastic.

6. A throw dart according to claim 1, wherein the stabilizer is inserted into a slot on an end of the shaft that is facing away from the dart body.

* * * * *